US009957091B2

(12) United States Patent
Bonin

(10) Patent No.: US 9,957,091 B2
(45) Date of Patent: May 1, 2018

(54) LIP PROTECTOR FOR USE ON CANNED BEVERAGES

(76) Inventor: Roger Bonin, Salaberry-De-Valleyfield (CA)

( * ) Notice: Subject to any disclaimer, the term of this patent is extended or adjusted under 35 U.S.C. 154(b) by 1824 days.

(21) Appl. No.: 12/941,041

(22) Filed: Nov. 6, 2010

(65) Prior Publication Data

US 2011/0108561 A1 May 12, 2011

(30) Foreign Application Priority Data

Nov. 11, 2009 (GB) ..... 0919737.7

(51) Int. Cl.
*A47G 19/22* (2006.01)
*B65D 51/00* (2006.01)
*B65D 51/20* (2006.01)

(52) U.S. Cl.
CPC ..... *B65D 51/007* (2013.01); *B65D 51/20* (2013.01)

(58) Field of Classification Search
USPC ..... 220/716, 717, 718, 254.2, 254.3
See application file for complete search history.

(56) References Cited

U.S. PATENT DOCUMENTS

| | | | | |
|---|---|---|---|---|
| 622,564 | A | 4/1899 | Tebbetts | |
| 1,034,636 | A | 8/1912 | McNair | |
| 1,344,179 | A | 6/1920 | Lopez et al. | |
| 1,944,045 | A | 1/1934 | Trampier, Sr. | |
| D112,449 | S | 12/1938 | Hall | |
| 3,690,509 | A | 9/1972 | Kinolan et al. | |
| 4,679,702 | A * | 7/1987 | Maccarone et al. | 220/717 |
| 5,402,904 | A * | 4/1995 | Close | 220/254.3 |
| 6,073,797 | A * | 6/2000 | Barous | 220/716 |
| 2003/0222083 | A1* | 12/2003 | Pladsbjerg | 220/254.3 |

* cited by examiner

*Primary Examiner* — Jeffrey Allen

(57) ABSTRACT

A lip protector for use on canned beverages has a cover member formed in the shape of a section of the top of an ordinary beverage can to therefore be adapted to removably and securely fit upon the external top of the can. The cover member including a drinking opening adapted to correspond to a drinking opening of the can; and a tab pivotally connected to the cover member having a shape adapted to snugly and removably fit within the drinking opening of the cover, wherein the lip protector can be removably placed upon a beverage can and used to safely drink from the can without a person's lips touching an external surface of the can.

12 Claims, 5 Drawing Sheets

LIP PROTECTOR FOR USE ON CANNED BEVERAGES

FIELD OF THE INVENTION

The present invention relates generally to hygienic devices but more particularly to a lip protector for use on canned beverages.

BACKGROUND OF THE INVENTION

Because of increasing risks of infectious diseases, any type of product which can prevent the spread of germs is welcome. There are no practical, reliable and easy to use products aimed at protecting the mouth area of the user of an aluminum beverage container.

SUMMARY OF THE INVENTION

In view of the foregoing disadvantages inherent in the known devices now present in the prior art, the present invention, which will be described subsequently in greater detail, is to provide objects and advantages which are:

To provide for a simple and efficient way of protecting the lips, and the mouth area in general, from contracting infections when drinking from any types and sizes of beverage cans.

To attain these ends, the present invention generally comprises a cover member formed in the shape of a section of the top of an ordinary beverage can to therefore be adapted to removably and securely fit upon the external top of the can. The cover member including a drinking opening adapted to correspond to a drinking opening of the can; and a tab pivotally connected to the cover member having a shape adapted to snugly and removably fit within the drinking opening of the cover, wherein the lip protector can be removably placed upon a beverage can and used to safely drink from the can without a person's lips touching an external surface of the can.

In a preferred embodiment, the lip protector has an apron extending downwardly therefrom and adapted to cover an upper side portion of said can, and can be used for advertising purposes.

In a variant of the embodiment, the lip protector further has an apron extending downwardly therefrom and said apron having a panel extending downwardly from the apron therefrom, both being adapted to cover an upper side portion of said can, and can be used for advertising purposes.

The drinking opening of the cover member includes at least one integral frictional member adapted to removably and securely attach to the drinking opening of the beverage can.

The lip protector has the tab member further including at least one winglet adapted to interact with an edge portion of the drinking opening of the cover member, such that the winglet can be used to removably and securely close the drinking openings.

The lip protector has a spout member frictionally attached to the periphery of the drinking opening and adapted to allow liquid to pass from the beverage can through the drinking openings and pass therethrough and into the mouth of the person.

The lip protector is formed from a material chosen from a list of materials including rubber, plastic, Styrofoam, and any substitute organic composites thereof.

In combination with a can the lip protector has a beverage can having a drinking opening on a top thereof, and a lip protector comprising a cover member formed in the shape of a section of the top of the beverage can to therefore be removably and securely fit upon the external top of the can. The cover member including a drinking opening corresponding to the drinking opening of the can; and a tab pivotally connected to the cover member having a shape adapted to snugly and removably fit within the drinking opening of the cover, wherein the lip protector can be removably placed upon the beverage can and used to safely drink from the can without a person's lips touching an external surface of the can.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter which contains illustrated preferred embodiments of the invention.

DETAILED DESCRIPTION OF THE PREFERRED EMBODIMENT

Figure 1:
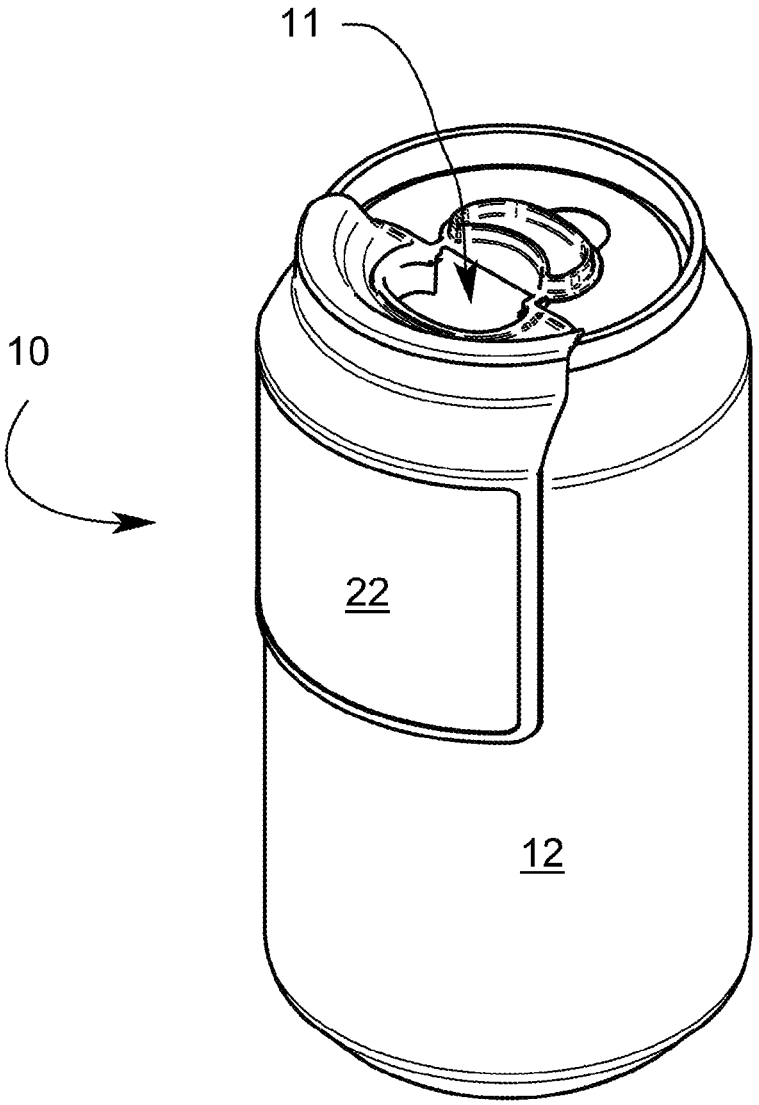
FIG. 1 Isometric view of the invention in context.
Figure 2:
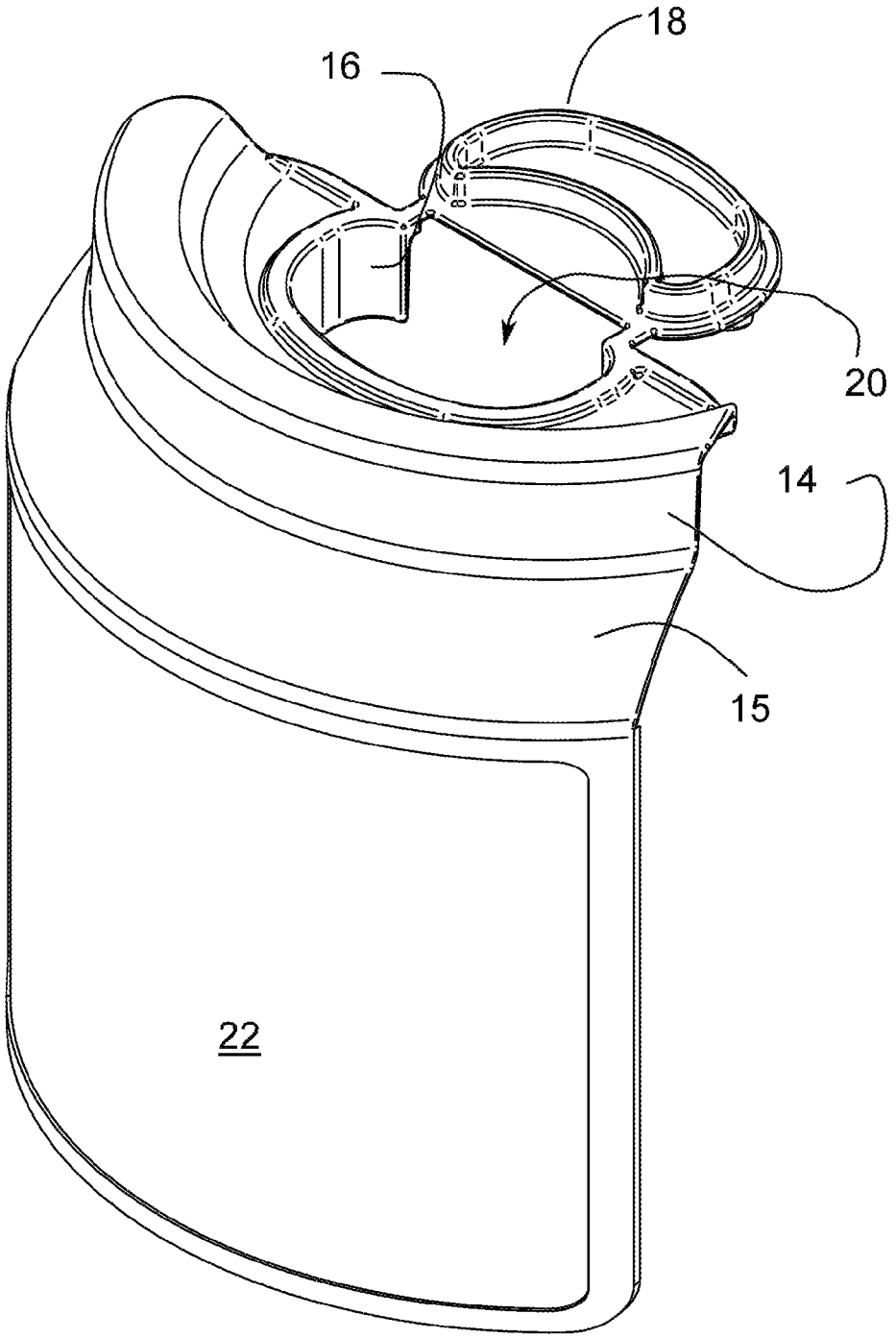
FIG. 2 Isometric view of the invention.
Figure 3:
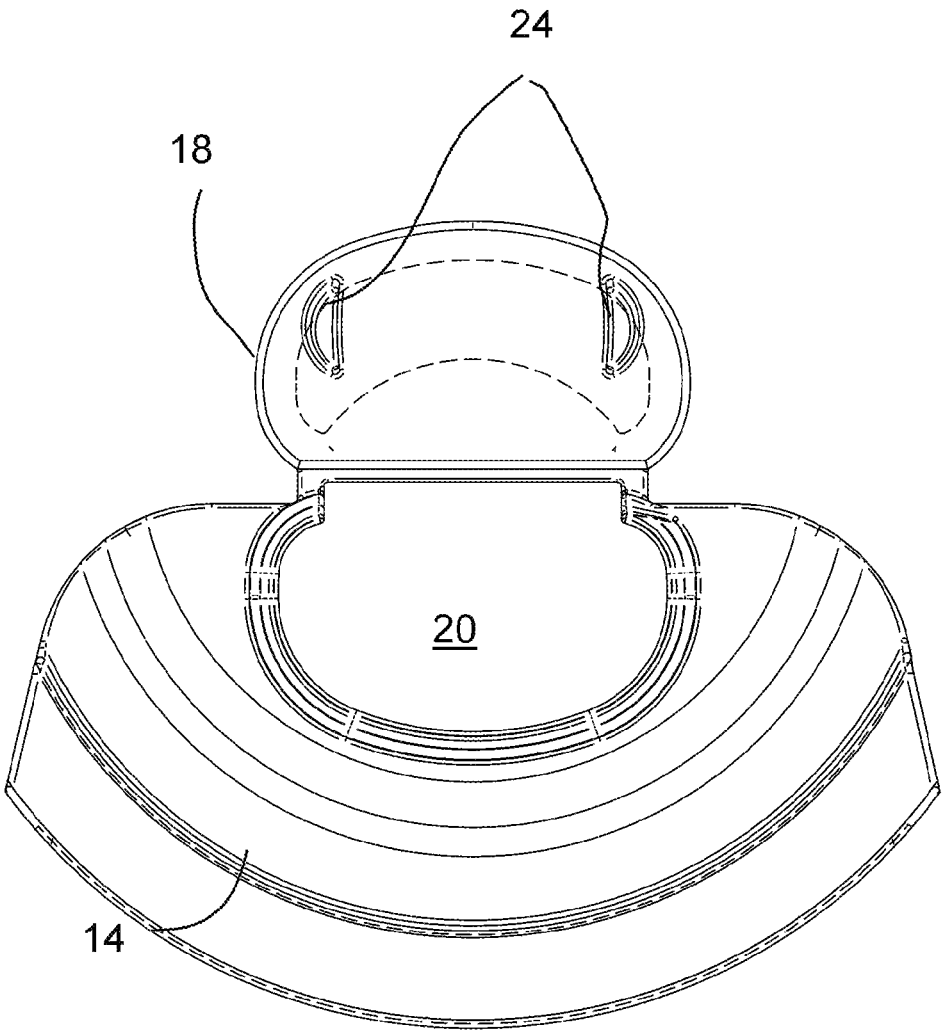
FIG. 3 Top view of the invention.
Figure 4:
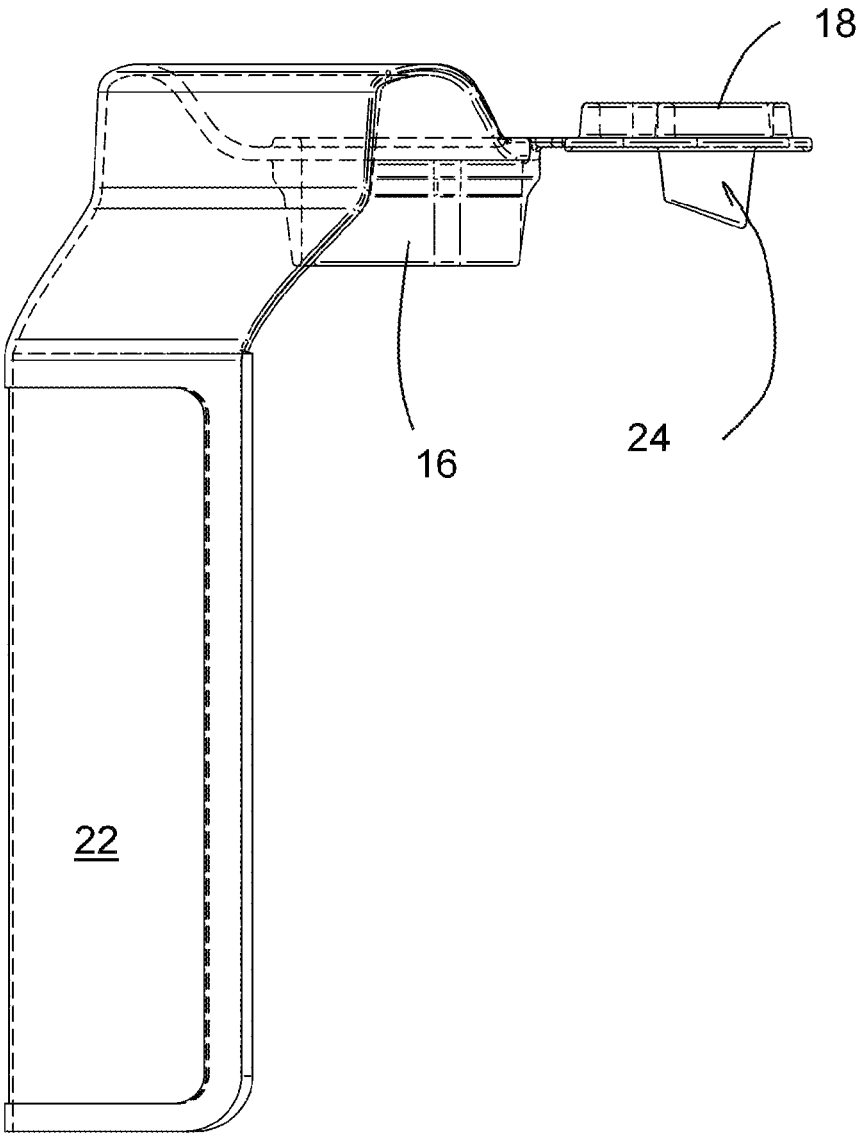
FIG. 4 Side view of the invention.

A lip protector (10) for a can (12) of beverage has a cover member (14) which is positioned on an external top part of the can (12) and from which integrally and downwardly extends an apron (15) from which extends integrally and downwardly a panel (22). The cover member (14) also has a cover member drinking opening (20) which corresponds to the drinking opening (11) of a can (12). A spout (16) having a frictional member frictionally attached to the periphery of the drinking opening (11). In that manner, the lip protector (10) is securedly but releasably attached to the can (12).

A tab (18) has two functions: The first is to allow for the quick removal of the lip protector (10) from the can (12) by simply pulling on it, and the second is for closing the drinking opening (11). A pair of winglets (24) act as frictional elements with the frictional member (16) to securedly keep the tab (18) closed within the opening. The panel (22) can be used for promotional purposes and the cover member is adapted to extend around only a section of the circumference of the extent top of the can so that the section is less than the entire circumference of the top of the can.

Figure 5:
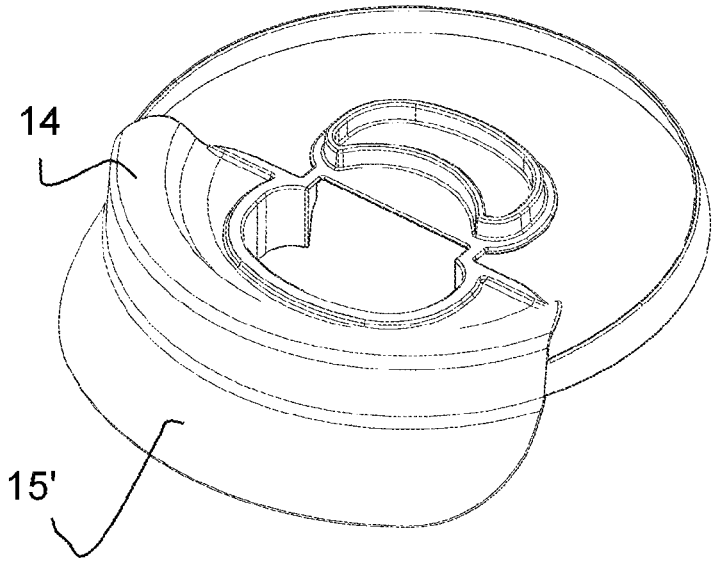
FIG. 5 Isometric view of an alternate embodiment of the invention.

FIG. 5 shows a variant of the invention wherein there is no panel and on which a modified apron (15') with rounded edges can act as a display for promotional purposes.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

The invention claimed is:

1. A lip protector for a beverage can, said lip protector comprising a cover member formed in the shape of a section of the top of an ordinary beverage can to therefore be adapted to removably and securely fit upon the external top of said can; said cover member being adapted to extend around only a section of the circumference of said external top of said can, wherein said section is less than the entire circumference of said top of said can; said cover member including a drinking opening adapted to correspond to a drinking opening of said can; a tab pivotally connected to said cover member having a shape adapted to snugly and removably fit within said drinking opening. of said cover; an apron extending downwardly from said cover and adapted to cover an upper side portion of said can; and a panel extending downwardly from said apron adapted to cover a middle side portion of said can; said apron and said panel both having rounded edges adapted to grip said upper and middle side portions of said can to thereby removably hold said lip protector securely upon said can and used to safely drink from said can without a person's lips or hands touching an external surface of said can; wherein said lip protector can be easily removably placed upon a beverage can and used to safely drink from said can without a person's lips touching an external surface of said can; and wherein said drinking opening of said cover member includes at least one integral frictional member adapted to removably and securely attach to said drinking opening of said beverage can.

2. The lip protector of claim 1, wherein said tab member further includes at least one winglet adapted to interact with an edge portion of said drinking opening of said cover member, such that said winglet can be used to removably and securely close said drinking openings.

3. The lip protector of claim 1, wherein said tab member further includes a spout member extending integrally therefrom and is adapted to allow liquid to pass from said beverage can through said drinking openings and pass therethrough and into the mouth of said person.

4. The lip protector of claim 1, wherein said lip protector is formed from a material chosen from a list of materials including rubber, plastic, Styrofoam, and composites thereof.

5. A combination of a beverage can and a lip protector, said combination comprising a beverage can having a drinking opening on a top thereof, and a lip protector comprising a cover member formed in the shape of a section of the top of said beverage can to therefore be removably and securely fit upon the external top of said can; said cover member being adapted to extend around only a section of the circumference of said external top of said can, wherein said section is less than the entire circumference of said top of said can; said cover member including a drinking opening corresponding to said drinking opening of said can; and a tab pivotally connected to said cover member having a shape adapted to snugly and removably fit within said drinking opening of said cover, an apron extending downwardly from said cover and adapted to cover an upper side portion of said can; and a panel extending downwardly from said apron adapted to cover a middle side portion of said can; said apron and said panel both having rounded edges adapted to grip said upper and middle side portions of said can to thereby removably hold said lip protector securely upon said can and used to safely drink from said can without a person's lips or hands touching an external surface of said can; wherein said drinking opening of said cover member includes at least one integral frictional member adapted to removably and securely attach to said drinking opening of said beverage can.

6. The combination of claim 5, wherein said lip protector further comprises an apron extending downwardly therefrom and adapted to cover an upper side portion of said can, and can be used for advertising purposes.

7. The combination of claim 5, wherein said tab member further includes at least one winglet adapted to interact with an edge portion of said drinking opening of said cover member, such that said winglet can be used to removably and securely close said drinking openings.

8. The combination of claim 5, wherein said tab member further includes a spout member extending integrally therefrom and is adapted to allow liquid to pass from said beverage can through said drinking openings and pass therethrough and into the mouth of said person.

9. The combination of claim 5, wherein said lip protector is formed from a material chosen from a list of materials including rubber, plastic, Styrofoam, and composites thereof.

10. The combination of claim 5, wherein said lip protector has an apron having rounded edges to be used as a display for promotional purposes.

11. The lip protector of claim 1, wherein said section is less than 180 degrees of the entire circumference of said top of said can.

12. The combination of claim 5, wherein said section is less than 180 degrees of the entire circumference of said top of said can.

* * * * *